United States Patent [19]

Mahieu

[11] 4,121,187

[45] Oct. 17, 1978

[54] HIGH SPEED RATIO, DUAL FUSE LINK

[75] Inventor: William R. Mahieu, Centralia, Mo.

[73] Assignee: A. B. Chance Company, Centralia, Mo.

[21] Appl. No.: 808,656

[22] Filed: Jun. 21, 1977

[51] Int. Cl.[2] ..... H01H 71/10; H01H/71/20

[52] U.S. Cl. ..... 337/171;337/217; 337/292

[58] Field of Search ..... 337/171, 168, 144, 169, 337/170, 217, 291, 292

[56] References Cited

U.S. PATENT DOCUMENTS

| | | | |
|---|---|---|---|
| 1,740,699 | 12/1929 | Murray | 337/217 |
| 2,416,428 | 2/1947 | Boothe | 337/291 |
| 2,493,601 | 1/1950 | Smith, Jr. | 337/292 |
| 2,750,470 | 6/1956 | McBride | 337/171 |

*Primary Examiner*—Harold Broome

*Attorney, Agent, or Firm*—Schmidt, Johnson, Hovey & Williams

[57] ABSTRACT

A relatively low cost dual element fuse link including a meltable solder junction has a pair of thermally insulated, serpentine, fusible elements supported on opposite sides of the junction for increasing the heat transferred to the junction by the elements in response to a given current carried by the link such that the junction will be caused to melt at lower current values thereby providing the link with an increased speed ratio. A pair of cylindrical porcelain insulators disposed along respective serpentine elements present the desired thermal insulation as well as provide structural stability to the elements precluding deformation of their serpentine shape when the fuse link is under tension as in a distribution system cutout. The serpentine shape of the elements presents an increased element length which in turn reduces the temperature gradient along the elements thereby reducing axial conductive heat loss from the ends of the elements remote from the solder junction.

21 Claims, 5 Drawing Figures

HIGH SPEED RATIO, DUAL FUSE LINK

This invention generally relates to replaceable current interrupting fuse links of the type designed for use with protective cutouts in an electrical distribution system. More particularly, the invention concerns a low cost, high speed ratio dual element fuse link having improved heat transfer characteristics for more efficiently utilizing heat generated to melt the low current responsive element.

Dual element fuse links are known in the art as illustrated for example by the SloFast fuse links manufactured by the A. B. Chance Company, Centralia, Mo., and shown in their 1974 catalog at pages 10C-5 through 10C-7 and the Chance Type MS fuse links illustrated in the same catalog at page 10C-9. Another dual element fuse link, similar in construction to the Chance Type MS fuse link, is produced by James R. Kearney Corporation, St. Louis, Mo. Such fuse links are provided with separate current responsive elements to operate the fuse link under different current conditions. A slow current responsive element is intended to operate the fuse when a predetermined overload current is experienced for a significant length of time. The fast current responsive element is intended to operate when a predetermined high fault current is experienced for even a very brief period of time. Prior art devices have employed a meltable solder junction and heat transfer means as the slow current responsive element and a fusible wire as the fast current responsive element.

Typically, the performance of dual element fuse links is rated by a value known in the trade as the speed ratio. This ratio is defined as the current which will actuate the fuse link in 0.1 second divided by the current which actuates the fuse link in 300 seconds. Typically, the speed ratio of conventional dual element fuse links is less than 20.

However, under certain applications, it may be desirable to employ a dual element fuse having a speed ratio significantly higher than the typical value of 20 permitted by conventional dual element fuse links. For example, many utility companies have long desired to protect the lightning arrestor component of their distribution transformer installation with the current interrupting fuse link. However, to make such an installation practical, it is necessary that the fast current responsive element in the dual element fuse link permit conductance of current values typically associated with lightning strokes without operating the fuse link. Otherwise, electrical service would unnecessarily be interrupted by even mild lightning strokes needlessly costing the utility company time and money to restore the interrupted service. But this requirement presents a problem because, when a dual fuse link is selected having an upper current value (current required to operate the fuse link in 0.1 second) sufficient to handle a reasonable percentage of lightning strokes, the lower current value (current required to operate the fuse link in 300 seconds) as directed by the typical speed ratio of 20 is not sufficient to adequately protect small KVA transformers (below 50 kva) from operating overloads. That is to say, once the required upper current value is determined, an unsatisfactory minimum lower current value is dictated by the maximum speed ratio available with typical dual element fuse link designs. For this reason, utility companies have almost universally installed their lightning arrestors unprotected on the source side of the system rather than run the risk of damaging the distribution transformer.

Higher speed ratios have been obtained in prior art devices by designing the heat generating elements in such a manner that greater heat is produced for the same amount of current. For example, the Kearney fuse link mentioned hereinabove has a speed ratio which approaches 40. However, one problem with increased heat generation is greater undesired wattage loss within the fuse link.

Accordingly, it is an important object of my invention to provide a dual element fuse link which reduces the heat losses from the heat generating element thereby melting the low current responsive element at lower values of current.

In accordance with the foregoing objects, it is a further important object of the instant invention to provide a dual element fuse link having a pair of serpentine fusible elements in electrical communication with a meltable solder junction disposed intermediate the fusible elements.

Another important object of my invention is to provide a dual fuse link as above wherein the fusible elements function as heat generating elements for melting the solder junction at low current values, the serpentine shape of the elements presenting an increased element length resulting in a lower temperature gradient along the elements for reduced heat loss from the ends of the elements remote from the solder junction.

It is yet a further important object of my invention to provide a dual element fuse link as above having a thermal-insulative member for each serpentine fusible element for more efficient conductive heat transfer from the elements to the solder junction.

As corollary to the foregoing object, it is still a further aim of my invention to engage each serpentine fusible element with a thermal-insulative member in such manner as to provide structual stability to the elements as well as to improve the thermal conductivity of the latter.

Figure 1:
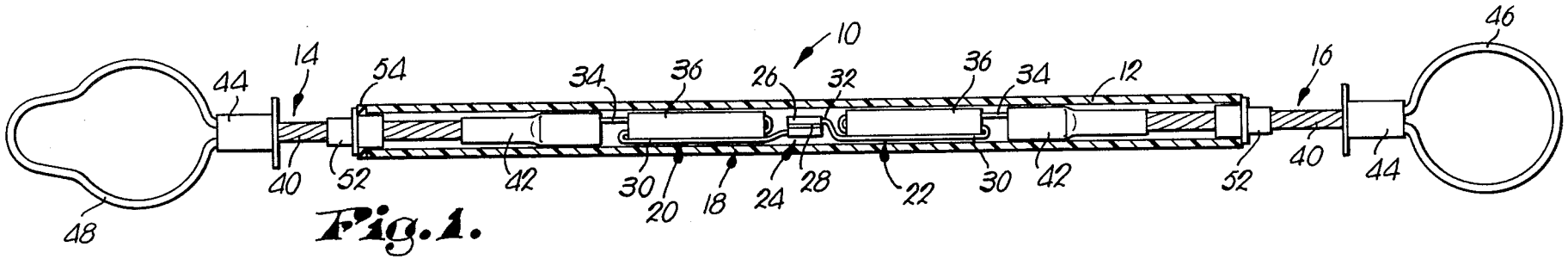
FIG. 1 is an elevational view of a high speed ratio, dual fuse link constructed in accordance with the principles of my invention and having portions shown in section for clarity.

In FIG. 1 there is shown a dual element openlink-type fuse link 10 including an elongate, nonconductive, auxiliary tube 12, a pair of spaced conductors 14, 16 disposed at opposite ends of the tube 12, and a current responsive assembly 18 positioned within the tube 12 intermediate the conductors 14, 16. Though not shown, it is to be understood that the principles of the present invention apply equally as well to buttonhead-type fuse links intended for use with a fuse holder in a closed or open cutout.

The current responsive assembly 18 has a pair of substantially identical serpentine fusible elements 20, 22 and a meltable solder junction 24 disposed intermediate the elements 20, 22. The junction 24 includes a pair of metal plates 26 each coupled to a respective element 20, 22 and a bead 28 of 80/20 Sn-Pb solder releasably bonding the plates 26 to one another. The bond formed by the bead 28 is destroyed when the temperature of the junction 24 is raised above the melting point of the 80/20 solder, which is approximately 190° Celsius.

Each of the elements 20, 22 is formed of a shaped piece of wire 30 having one end 32 coupled with a respective plate 26 and an opposed end 34 attached to a respective one of the conductors 14, 16. In the preferred embodiment, the material for wires 30 is Nichrome 5 (80% Ni, 20% Cr) although Advance (57% Cu, 43% Ni) has also been used successfully. The melting point for Nichrome 5 is approximately 1400° Celsius whereas the melting point of Advance is 1210° Celsius.

Each of the elements 20, 22 has associated therewith a thermal-insulator 36. Each insulator 36 has a pair of parallel, laterally offset, through passages 38 extending axially of the insulator 36.

In practice, it has been found that the suitability of a particular material for use in the construction of wires 30 to obtain a high speed ratio can be readily evaluated by calculating a ratio between certain physical properties of the material. This ratio is derived from a complicated mathematical model and can be referred to as the fusible element parameter. The parameter is equal to:

$$\frac{dc\,Tmp}{K}$$

Where:

$d$ = density (gm/cm$^3$)
$c$ = specific heat (calories/gm ° C.)
$Tmp$ = melting point (° C.)
$K$ = thermal conductivity (calories/cm-sec)

It has been found that the higher the fusible element parameter, the higher the speed ratio, all other criteria being equal. An approximate material evaluation scale has been developed indicating that materials having a fusible element parameter of 100–150 are good, materials having fusible element parameter of 150–200 are better, and materials having fusible element parameter greater than 200 are best. For example, the fusible element parameter of Nichrome 5 is 214 and has produced a speed ratio of 42 in one design of the fuse link 10 while Advance has a fusible element parameter of 141 producing a speed ratio of 35 in the same design of the fuse link 10. Ideally, the material used for wires 30 should have a high fusible element parameter and a low electrical resistivity.

Figure 2:
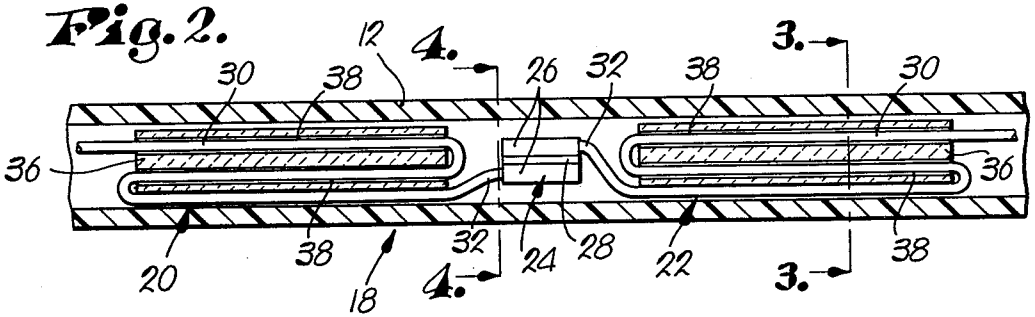
FIG. 2 is a fragmentary, enlarged, longitudinal cross-sectional view of the fusible elements and solder junction.
Figure 3:
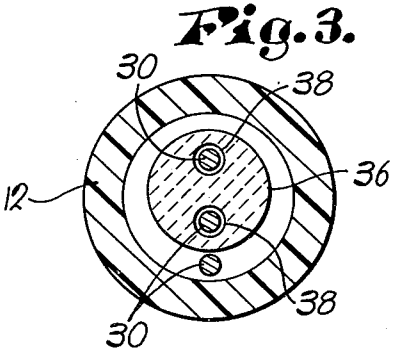
FIG. 3 is an enlarged, cross-sectional view taken along line 3—3 of FIG. 2.
Figure 4:
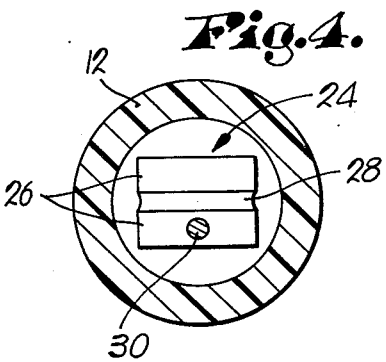
FIG. 4 is an enlarged, cross-sectional view taken along line 4—4 of FIG. 2.

As shown in FIG. 2, the serpentine configuration of the elements 20, 22 is derived from a non-linear, S-shaped stretch formed in the wires 30, including a pair of arcuate segments aligned end-to-end. It is to be noted that the wires 30 are threaded through the passage 38 of their respective insulators 36 in such a manner that the S-shaped stretches are substantially surrounded by the insulator 36 and further are protected by the latter against deformation when the ends 32 are biased away from the ends 34. Hence, the insulators 36 not only thermally insulate the wires 30 but also provide structural rigidity thereto preventing deformation of the serpentine elements 20, 22. Of course, it will also be appreciated that the porcelain insulators 36 additionally function as electrical insulators preventing a short circuit across the non-linear stretches of the wires 30.

The shape and insulation of the heat generating elements 30 serve to reduce the rate of heat loss from these elements, thereby lowering the current which will melt the solder junction 24, for a given rate of electrical power loss in the fuse. The serpentine shape allows a greater element length, which decreases the temperature gradient axially and thus decreases the conductive heat loss rate from the ends 34 to the relatively cool terminals 42. The insulators 36 serve to decrease radial heat loss from the heat generating elements 30 to the ambient air outside tube 12. This radial heat loss is determined by a series of thermal resistances, conductive through solid walls of the insulator 36 and tube 12, and convective at each air-solid interface. The insulator functions to increase this thermal resistance primarily by increasing the number of air-solid interfaces between the heat generating elements and the ambient air.

The conductors 14, 16 each comprise a flexible cable 40 having a wire receiving terminal 42 at one end and a contact button 44 at the opposite end. The wire receiving terminals 42 are securely attached to respective ends 34 of elements 20, 22 such that the buttons 44 are disposed at opposed ends of the fuse link 10. The conductor 16 is further provided with a circular retainer ring 46 on its outermost end and a similar pear-shaped retainer ring 48 is disposed on the outermost end of the conductor 14.

The nonconductive auxiliary tube 12 is centrally disposed between the buttons 44 in surrounding relationship to the current responsive assembly 18 and the wire receiving terminals 42. The internal diameter of the tube 12 is only slightly larger than the diameter of the cylindrical insulators 36 such that the latter are snugly received within the tube 12. The ends of the tube 12 are closed by a pair of opposed collars 52 carried on respective conductors 14, 16. Additionally, a resilient washer 54 is disposed between one end of the tube 12 and the collar 52 carried by the conductor 14 for the purpose of providing a weather seal.

Figure 5:
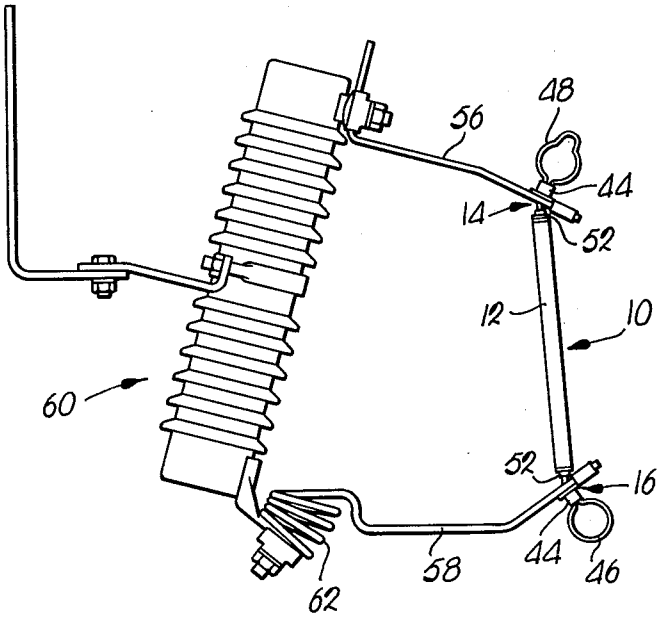
FIG. 5 is a side elevational view showing the fuse link operably installed in an openlink-type distribution cutout.

In FIG. 5, the fuse link 10 is shown operably disposed between the upper and lower contact arms 56, 58 of an openlink-type distribution cutout 60. When properly positioned, the conductor 14 engages the upper arm 56 whereas the conductor 16 engages the lower arm 58. A coil spring section 62 on the lower arm 58 serves to bias the conductors 14, 16 away from one another. In this manner, the current responsive assembly 18 is placed under tension to assure positive separation of the current responsive assembly 18 after melting for assisting in arc interruption under low fault current and overload conditions.

In operation, the fuse link 10 is typically used in conjunction with the cutout 60 to protect a distribution transformer against damaging fault currents and excessive overloads as well as to protect the distribution system from fault currents occuring within the transformer.

When the fuse link 10 sees a high fault current, one of the fusible elements 20, 22 is melted thereby interrupting the current and preventing damage to the transformer. This current interrupting process is similar to that in conventional fuse links, it being understood that the tube 12 is provided with an inner layer of bone grade fiber material for generation of arc-suppressing, deionizing gas in response to arcing in the tube 12.

On the other hand, should the fuse link 10 see a short duration, intermediate fault current falling below the safe loading time-current curve for the protected transformer, the current is conducted without operation of the fuse link 10 and consequently with no interruption of electrical service. Of course, the value of the current which will be conducted without melting the elements 20 or 22 depends upon the size and material composition of the wires 30.

If relatively long duration overload currents are experienced which are not sufficient to cause melting of the fusible elements 20, 22, the fuse link 10 nevertheless will operate to interrupt the damaging current by melting of the solder junction 24. In this connection, the electrical resistance of wires 30 causes heat to be generated along the length thereof which heat is transferred by conduction to the solder junction 24 causing a rise in the temperature of the plates 26. As can be appreciated, the rate of heat generated in the wires 30 is directly proportional to the square of the current therein such that increased current will in turn effect an increase in the temperature of the plates 26. When a current of sufficient magnitude and duration is carried in the wires 30 to increase the temperature of the plate 26 above the melting temperature of the solder bead 28, the current flow is interrupted. Thus, the solder junction 24 in cooperation with the heat generating function of the elements 20, 22 serves as the slow current responsive element in the fuse link 10. It is important to note that short duration fault currents will not normally cause melting of the junction 24 inasmuch as the heat transfer process requires time to reach an equilibrium position.

In order to obtain desired high speed ratios, in fuse links which do not melt or are not otherwise damaged by lightning surge or magnetizing inrush currents, it is normally required that the junction 24 melt at relatively low current values. In the fuse link 10, the current required to melt the junction 24 is lowered by reducing the rate of heat loss from the elements 30. This results in higher transient element temperatures and increased rate of heat transfer to the low melting point solder junction 24. Thus, the minimum melting current is reduced and the speed ratio increased.

It will be appreciated that the amount of heat generated in the wires 30 is directly proportional to their length and that heat transfer will occur from the wires 30 axially by conduction as well as radially by conduction and convection. The unique serpentine shape of the elements 20, 22 disposes a substantial length of wire 30 in close proximity to the junction 24 such that a significantly greater amount of heat is generated by the elements 20, 22 immediately adjacent the junction 24. Moreover, the insulators 36 greatly reduce radial heat loss from the wires 30 such that most of the generated heat is transferred by conduction to ends 32 and 34.

By positioning the junction 24 intermediate the elements 20, 22 heat is received from two directions by the junction 24 such that the latter is the hottest point in the current responsive assembly 18 after the temperatures have stabalized. Further, this central disposition of the junction 24 spaces the same a maximum distance from the heat sinks presented by the wire receiving terminals 42 on respective conductors 14, 16.

Additionally in this regard, the amount of heat transferred by conduction from the elements 20, 22 to the terminals 42 is minimized by the increased length of the S-shaped wires 30. This for the reason that the conductive heat transfer from the ends of elements 20, 22 in contact with the terminals 42 is directly proportional to the temperature gradient along the elements 20, 22. This temperature gradient decreases as length increases such that the gradient along elements 20, 22 is significantly lower than in corresponding elements of prior art devices. Hence, the amount of heat lost to the terminals 42 is also reduced, thereby contributing to the more efficient heat transfer to the solder junction 24.

From the foregoing, it can be seen that the present invention embodied by the fuse link 10 offers a significant improvement over fuse links heretofore available. The fuse link 10 has a high speed ratio for overload protecting of low KVA transformers while at the same time avoiding unnecessary outages due to lightning surges or magnetizing inrush currents all without excessive wattage loss within the fuse link 10. Hence, the fuse link 10 is well suited for installation on the source side of lightning arrestors for protecting the latter in addition to providing protection for the distribution transformer.

Moreover, the construction of the fuse link 10 is such that manufacturing costs are significantly less than many prior art dual element fuse links. In this connection, the electrical and heat generating circuits are one in the same such that there is no need to isolate one from the other. The unique multi-purpose construction and arrangement of the insulators 36 provides thermal and electrical insulation as well as giving structural support to the elements 20, 22 such that the latter maintain their serpentine shape even when the fuse link 10 is under tension as for example when disposed in the open link cutout 60.

I claim:

1. A dual element, high speed ratio fuse link including:

a pair of spaced conductors, a solder junction intermediate said conductors;

a pair of heat-generating fusible elements each extending from said junction to a respective one of said conductors;

at least one of said elements having a non-linear stretch comprising a series of arcuate segments connected end-to-end; and a thermal-insulative member disposed along the length of said non-linear stretch in substantially surrounding engagement with the latter for providing structural support to said one element and for more efficient heat transfer from said one element to said solder junction thereby causing melting of the junction at lower current values.

2. The fuse link of claim 1, said non-linear stretch extending substantially the full length of said one element and comprising a longitudinally serpentine conductive wire of a length greater than the distance between said solder junction and its conductor for providing a reduced temperature gradient along the one element thereby decreasing conductive heat loss to its associated conductor.

3. The fuse link of claim 2, said thermal-insulative member comprising a porcelain insulator having a number of passages formed therein for receiving said non-linear stretch.

4. The fuse link of claim 3, said solder junction being disposed equidistant from said conductors.

5. The fuse link of claim 4, the configuration of the other of said elements being substantially identical to the configuration of said one element, and comprising a serpentine wire identical to said first mentioned wire, there being a second thermal insulative member for the non-linear stretch of said other element.

6. The fuse link of claim 5, said conductors being adapted for biasing in opposite directions, said members resisting deformation of said non-linear stretches when said conductors are oppositely biased.

7. The fuse link of claim 5, said wires being equal in length and diameter.

8. The fuse link of claim 7, said wires being constructed of the same material.

9. The fuse link of claim 8, said material being a Cu—Ni alloy.

10. The fuse link of claim 9, said material being 57% Cu and 43% Ni by composition.

11. The fuse link of claim 8, said material being a Ni—Cr alloy.

12. The fuse link of claim 11, said material being 80% Ni and 20% Cr by composition.

13. The fuse link of claim 8, said material having a melting point between 1100° Celcius and 1500° Celsius.

14. The fuse link of claim 1, said thermal insulative member being cylindrical and having a pair of parallel, laterally spaced passages extending through the member axially thereof.

15. The fuse link of claim 14, said member being ceramic.

16. The fuse link of claim 5, and an auxiliary tube disposed between said conductors in covering relation to said solder junction and said fusible elements.

17. The fuse link of claim 16, said thermal-insulative member being cylindrical and having a diameter slightly smaller than the inside diameter of said tube.

18. The fuse link of claim 5, said conductors each being provided with a retainer thereby rendering the fuse link adaptable for openlink applications.

19. The fuse link of claim 8, said material having a fusible element parameter in the range of 100–150.

20. The fuse link of claim 8, said material having a fusible element parameter in the range of 150–200.

21. The fuse link of claim 8, said material having a fusible element parameter greater than 200.

* * * * *